United States Patent [19]

Hansen

[11] 4,125,363

[45] Nov. 14, 1978

[54] ROTARY KILN PLANT

[75] Inventor: Dan S. Hansen, Copenhagen Valby, Denmark

[73] Assignee: F. L. Smidth & Co., Cresskill, N.J.

[21] Appl. No.: 731,983

[22] Filed: Oct. 13, 1976

[30] Foreign Application Priority Data

| | | | |
|---|---|---|---|
| Oct. 15, 1975 | [GB] | United Kingdom | 42221/75 |
| Nov. 19, 1975 | [GB] | United Kingdom | 47632/75 |
| Feb. 4, 1976 | [GB] | United Kingdom | 4362/76 |

[51] Int. Cl.[2] ..... F27B 7/02

[52] U.S. Cl. ..... 432/106; 432/14

[58] Field of Search ..... 432/14–16, 432/58, 103, 105, 106, 111; 34/10, 57 R, 57 A, 57 D; 106/100

[56] References Cited

U.S. PATENT DOCUMENTS

| | | | |
|---|---|---|---|
| 2,750,182 | 6/1956 | Petersen | 432/58 |
| 3,547,417 | 12/1970 | Elkjaer | 432/106 |
| 3,865,602 | 2/1975 | Stich et al. | 432/16 |
| 3,904,353 | 9/1975 | Bosshand et al. | 432/106 |
| 3,940,241 | 2/1976 | Houd | 432/106 |
| 4,002,420 | 1/1977 | Christiansen | 432/106 |
| 4,014,641 | 3/1977 | Shigeyoshi et al. | 432/106 |

FOREIGN PATENT DOCUMENTS

| | | | |
|---|---|---|---|
| 1,157,528 | 11/1963 | Fed. Rep. of Germany | 432/106 |
| 1,185,892 | 3/1970 | United Kingdom | 432/106 |

*Primary Examiner*—Henry C. Yuen
*Attorney, Agent, or Firm*—Pennie & Edmonds

[57] ABSTRACT

A plant is disclosed for heat treating pulverous raw material such as cement raw meal prior to a final sintering process in a rotary kiln. The plant includes a rotary kiln having an upper material inlet end portion for the reception of preheated cement material and a lower material outlet end portion for exiting the final sintered kiln product. A multi-stage cyclone string preheater having at least a first stage for receiving the cement raw meal has a last stage communicating with the upper material inlet end portion of the kiln. A smoke chamber connects the upper material inlet portion of the kiln with the preheater, and a scoop chamber connects the kiln with the smoke chamber. The scoop chamber is adapted to receive preheated, at least partially calcined raw material from at least one preheater stage other than the last stage. The cement material received in the scoop chamber is dispersed so as to be suspended in the gases exiting the kiln and directed through the smoke chamber to the last stage of the associated preheater string. The preheated, at least partially calcined cement material is then directed from the last stage of the preheater string to the upper material inlet end portion of the kiln at a location upstream with respect to the kiln exiting gases, off the location of the dispersing means, so as to pass down through the kiln for further heat treatment.

39 Claims, 15 Drawing Figures

ROTARY KILN PLANT

BACKGROUND OF THE INVENTION

1. Field of the Invention

This invention relates to a rotary kiln plant for burning pulverous raw material such as cement raw meal.

2. Description of the Prior Art

In modern rotary kiln plants of the type contemplated herein, raw material is subjected to sintering and possibly to some final calcining in the kiln. The heat generated in the kiln is utilized in a multi-stage preheater and, if convenient, in a calciner. The temperature of the kiln exit gases which pass from the raw material inlet end of the kiln through a riser pipe and into a lowermost stage of the preheater may be so high as to pose a risk of damage to the kiln structure, particularly at its material inlet end and in the riser pipe. The high temperatures also encourage fine dust particles which are entrained in the hot exit gases of the kiln to cake at these localities especially when the burning raw materials contain chlorine and alkali components.

Several attempts have been made to remedy the problem of overheating of the kiln structure. For example, commonly assigned U.S. Pat. No. 2,750,182 to Petersen relates to a rotary kiln having on the inside of its upper end a dam ring and lifters which cause the raw material to pass into the flow of exit gas. The patent also discloses an opening for supplying atmospheric air to the riser pipe between the kiln and the preheater which cools the gases in the riser pipe.

An improvement of the system disclosed in the Petersen 2,750,182 patent is disclosed in British Patent specification No. 1,100,530 to Elkjaer wherein lifters are built into the dam ring to cause the cooling in the riser pipe to take place by supplying raw material from the penultimate stage of the preheater through a pipe and into the kiln inlet.

U.S. Pat. No. 3,839,058 discloses a construction for preventing cakings in and around the kiln inlet by providing a powerful fan in the exhaust gas outlet outside the kiln, thus ensuring an extra large dust circulation in the upper kiln end.

While the systems disclosed in these references provide effective heat treatment of the cement raw material, none disclose a system which fully utilizes the heat from the hot kiln exit gases while maintaining the temperature of the kiln outlet structure to within acceptable levels as would be desirable. I have invented a rotary kiln plant which avoids such disadvantages.

SUMMARY OF THE INVENTION

A plant for heat treating pulverous raw material which comprises a kiln having an upper material inlet end portion and a lower material outlet end portion. The kiln plant also comprises at least one multi-stage raw material string preheater having at least a first stage for receiving raw material to be preheated and a last stage communicating with the upper material inlet end portion of the kiln. A smoke conduit communicates the upper material inlet end portion of the kiln with the preheater. The invention also comprises means communicating the upper material inlet end portion of the kiln with the smoke conduit and adapted to receive preheated, at least partially calcined raw material from at least one preheater stage. The invention further comprises means associated with the communicating means for dispersing material received therein into the hot gases exiting the material inlet end portion of the kiln and means for feeding preheated, at least partially calcined material from at least one preheater stage preceding the last stage of the same preheater string such that at least a portion of the material is dispersed by the dispersing means and is thereby suspended in the gases exiting from the upper material inlet end portion of the kiln and directed through the smoke chamber to the last stage of the associated preheater string. The invention further comprises means for feeding the preheated, at least partially calcined material from the last stage of each preheater string to the upper material inlet end portion of the kiln at a location upstream with respect to the kiln exit gases, of the location of the dispersing means.

This construction provides an improved dispersion of the raw material from the penultimate or earlier preheater stages into the kiln exit gases and hence a significant lowering of the temperature at the upper inlet material end of the kiln.

The dispersing means may be in many different forms. For example, the dispersing means may be in the form of a rotary dispersing device which rotates with the kiln. Alternatively, it may be a stationary dispersing device. The dispersing device may be formed as a rotary or stationary sprinkling device mounted at the upper end of the kiln or at the slit between the upper end of the kiln and the lowermost riser pipe, or in the lowermost riser pipe proper. A rotary chamber formed with compartments such as scoops, pockets, or boxes is also contemplated.

A stationary device may be connected by the smoke chamber and consist of a sprinkling plate or surface mounted below the discharge end of the first feeding means located between the smoke chamber and upper material inlet end of the kiln. When the device is a stationary device, the resulting advantages include the avoidance of any rotary mechanism except the kiln, as well as the rather simple construction and functioning of the dispersing device.

In a preferred form, the dispersing means includes a scoop chamber rigidly connected to the upper material inlet end of the kiln and rotates with the kiln. The scoop chamber may have a plurality of scoop blades positioned about the inner peripheral portion of the scoop chamber. In this case, the radially innermost parts of the scoop blades may lie on a circle, the diameter of which is larger than the inside diameter of the upper inlet end of the kiln, but smaller than the inside diameter of the kiln proper due to the divergent configuration of the kiln from the material inlet end portion toward the kiln proper. The preheated, at least partially calcined material is fed from the penultimate preheater stage through a duct in the form of a pipe and is discharged into the scoop chamber immediately above the lowermost scoop blades. Since the raw material discharged into the scoop chamber directly from the penultimate or an earlier preheater stage (or stages) is at a temperature substantially lower than that of the exit gases, the material cools the scoop blades. As a result of being agitated and whirled into the kiln exit gases by the blades, the raw material also causes an abrupt cooling of the kiln exit gases. This abrupt cooling results in a substantial reduction of the disadvantageous imparting of the hot kiln gases on the kiln and preheater structure around the upper kiln end. To avoid damage to the scoop blades by the hot exit gases, the outermost parts of the blades may be recessed in relation to the inside diameter of the kiln end so as not to be positioned directly within the flow of hot gases from the kiln.

At its circumference, the scoop chamber (or dispersing device) may be provided with automatically or manually operated scuttles for selectively permitting atmospheric air to be drawn into the scoop chamber and the smoke chamber. This enables additional cooling of the exit gases in the event that the amount of raw material passing into the dispersing means is insufficient for reducing the risk of heat damage to the rotary dispersing device and the kiln structure. The same precaution may also be taken by means of an automatically operating air-sealing device, located between the scoop chamber and the smoke chamber, through which air may be drawn into the dispersing device.

Preferably, the entrance into the smoke chamber for receiving the kiln exit gases and the suspended material, is smaller than the full cross section of the upper kiln end. A substantial increase in the velocity of the exit gases and of the material passing through the smoke chamber and into the riser pipe results. The increased velocity reduces the residence time which the material spends in the smoke chamber and riser pipe and thereby reduces the risk of caking of the chlorine and/or alkali contents of the materials treated and entrained in the exit gases. The restriction in size of the opening in the smoke chamber for receiving kiln exit gases is conveniently achieved by dividing the cross section of the entrance into two parts (for example, upper and lower or right and left hand parts), one of which provides the passage for the kiln exit gases and entrained material, and the other providing the space through which one or both of the first and second feeding ducts deliver the material into the rotary dispersing device or upper kiln end upstream with respect to the flow of exit gases, of the rotary dispersing device. Since the feeding means are isolated from the hot kiln exit gases, the pipe work forming the duct (or ducts) is thus protected against damage resulting from the intense heat of the hot kiln gases.

This division of the cross section and protection to the pipe work can be obtained by forming the smoke chamber with a floor which is inclined downwardly toward the upper material inlet end portion of the kiln, and preferably terminating at a position which is part way up the cross section of the upper kiln end. The space above the floor may be utilized as the restricted passage for the kiln exit gases traveling into the smoke chamber. The space below the floor surface can accomodate the pipe work for the material feeding duct (or ducts) which may be positioned so as to follow the inclination of the floor and therefore provide an incline down which the material may fall down through the sloped pipe work into the upper kiln end. It is preferred to position below the floor, at least the feeding duct for preheated material from the last preheater stage to the kiln material inlet end. Alternately, this duct may be encapsulated within insulating material forming the floor.

At least one by-pass pipe for leading the hot exit gases directly from the interior of the kiln to a precipitator or the like may be provided and positioned in the lowermost portion of the upper kiln material inlet end. If convenient, the by-pass pipe may project beyond the rotary device and into the kiln. This pipe does not occupy any of the space necessary for appropriate functioning of the other kiln structures.

According to the invention, the kiln plant may comprise one or more parallel multi-stage preheater strings and the preheater may include a calcining unit having an additional supply of fuel. This additional fuel may be added to the raw materials fed to the preheater, or it may be added directly to the preheater proper. In the alternative, the fuel would be introduced at the riser pipe from the smoke chamber. Heated air in the form of spent cooling air from a material cooler which is connected to the lower kiln end, may be introduced into the rotary device or into the preheater. The air may serve as combustion air or as a secondary heat source for the calcination, or merely as a transport medium for use in injecting the material into the rotary dispersing device.

In addition, means such as a pipe may be provided for feeding supplementary atmospheric air to the kiln inlet via the duct used to feed raw material into the dispersing device from one of the preheater stages other than the last one. In addition, similar means may be provided for feeding supplementary air to the upper end of the kiln via the duct used for feeding raw material from the last preheater stage into the upper end of the kiln beyond the dispersing device.

This supplementary atmospheric air serves to increase the oxygen content at the kiln inlet, without an undesired temperature increase and thereby ensures a more complete combustion of the combustible parts of the kiln exit gases, which in turn limits the generation of the nitrogen oxides at the kiln inlet and the associated risk of formation of caking of nitrogen oxides at the kiln inlet, the smoke chamber, and riser pipe connected to the smoke chamber.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
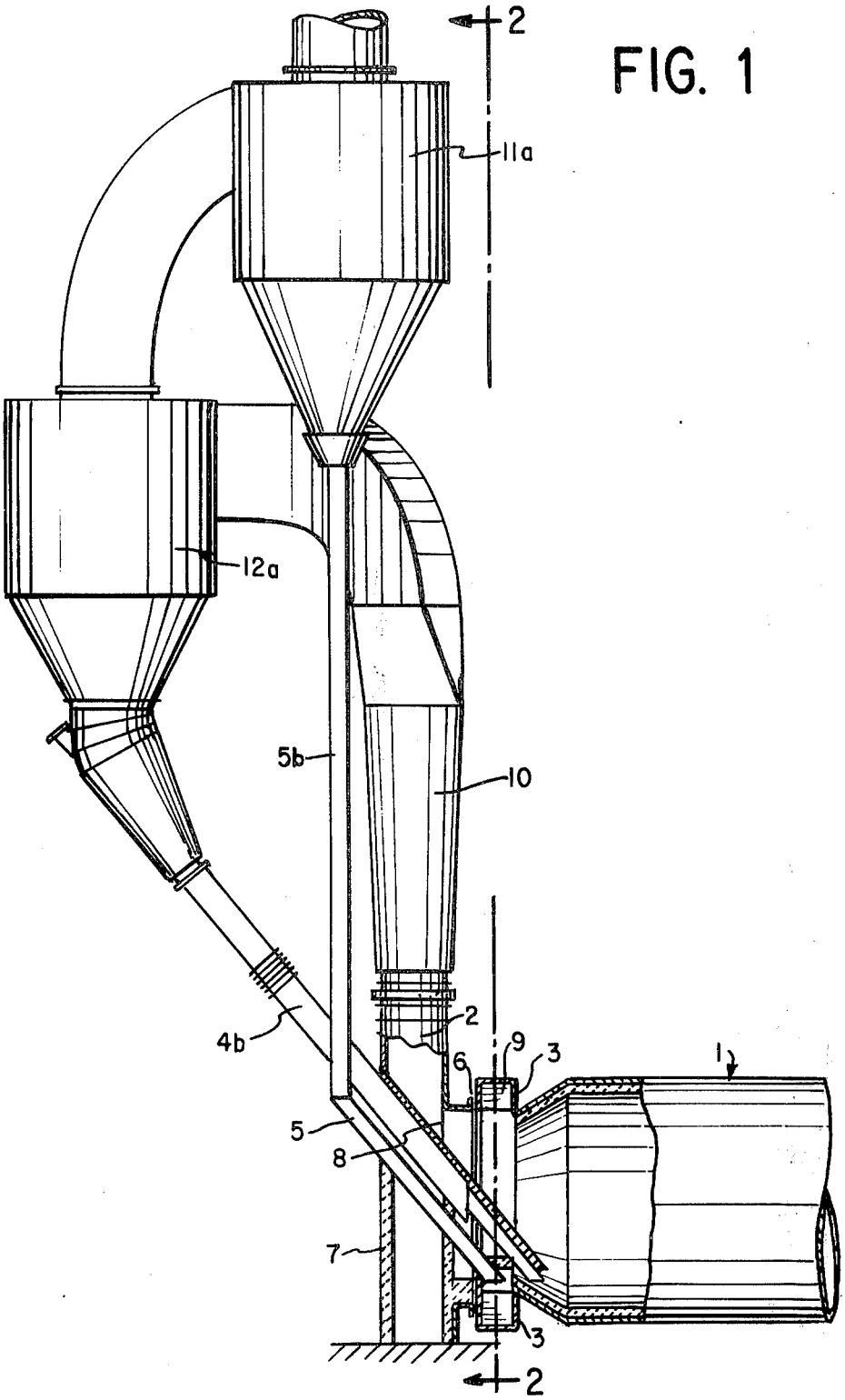
FIG. 1 is a side view, partially in cross-section, of a part of a rotary kiln plant constructed according to the invention.
Figure 2:
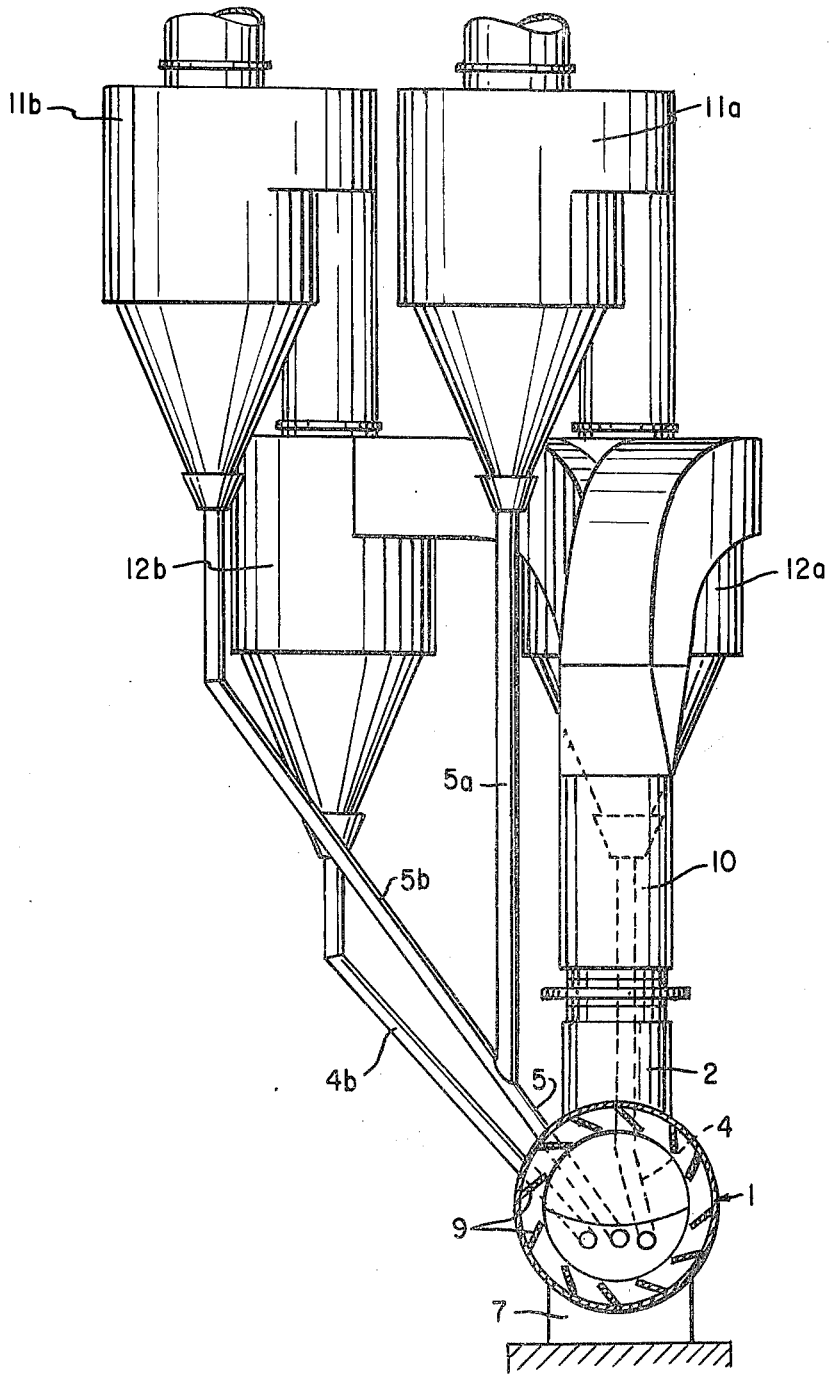
FIG. 2 is an end view, partially in cross-section, of the rotary kiln plant shown in FIG. 1.

Referring to FIGS. 1 and 2, there is illustrated a plant having a rotary kiln 1, a smoke chamber 2 which continues into a riser pipe 10, a scoop chamber 3 with scoops 9, pipes 4a, 4b for supplying raw material from lowermost preheater stages 12a, 12b to the kiln 1 and pipes 5, 5a and 5b for passing raw material to the scoop chamber 3 from penultimate preheater stages 11a, 11b. A sealing device 6 located between the scoop chamber 3 and the smoke chamber 2 and a support 7 for the smoke chamber 2 is also illustrated. The sealing device provides the facility for automatic air suction into the scoop chamber 3.

FIGS. 3 through 6 show in detail the upper material inlet end 1a of the kiln 1 and smoke gas chamber 2. The scoop chamber 3 has scoops 9 and scuttles 17. The scuttles may be automatically or manually controlled as illustrated schematically in FIG. 3. A seal 6 known in the art is located between the scoop chamber 3 and smoke chamber 2. Similar to the seal 6, the scuttles 17 permit the supply of atmospheric air to the interior of the scoop chamber should the raw meal fed to the lowermost part of the scoop chamber 3 through a pipe 5 fail to provide sufficient cooling of the hot kiln gases. The kiln has a divergent end 1a leading into the kiln proper 1 and the supply pipe 4 which receives raw meal form the lowermost preheater stage opens into the kiln at 4c. The supply pipe 5 which receives raw meal from the penultimate preheater stage discharges it into the scoop chamber 3 at 5c. The smoke chamber 2 has an inclined floor 2a which forms a restricted outlet 8. This restriction increases the velocity of the flow of exit gas and material which passes from the kiln 1 through the outlet 8 and into the smoke chamber 2. The inclined floor 2a also allows the pipe 4 to be introduced into the kiln opening 1a below the smoke chamber floor 2a. Supports 13, 14 and 15 are provided to support the pipe ends 4c and 16 at the kiln upper material inlet.

Figure 4:
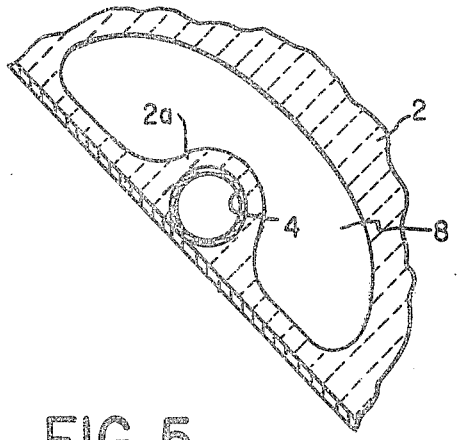
FIG. 4 is a cross-sectional view taken along lines 4—4 of FIG. 3.

FIG. 4 illustrates a possible configuration for the restricted outlet 8. In this embodiment, the location of the pipe 4 contributes further to limit the cross-sectional area of the opening 8 to the smoke chamber 2.

Figure 3:
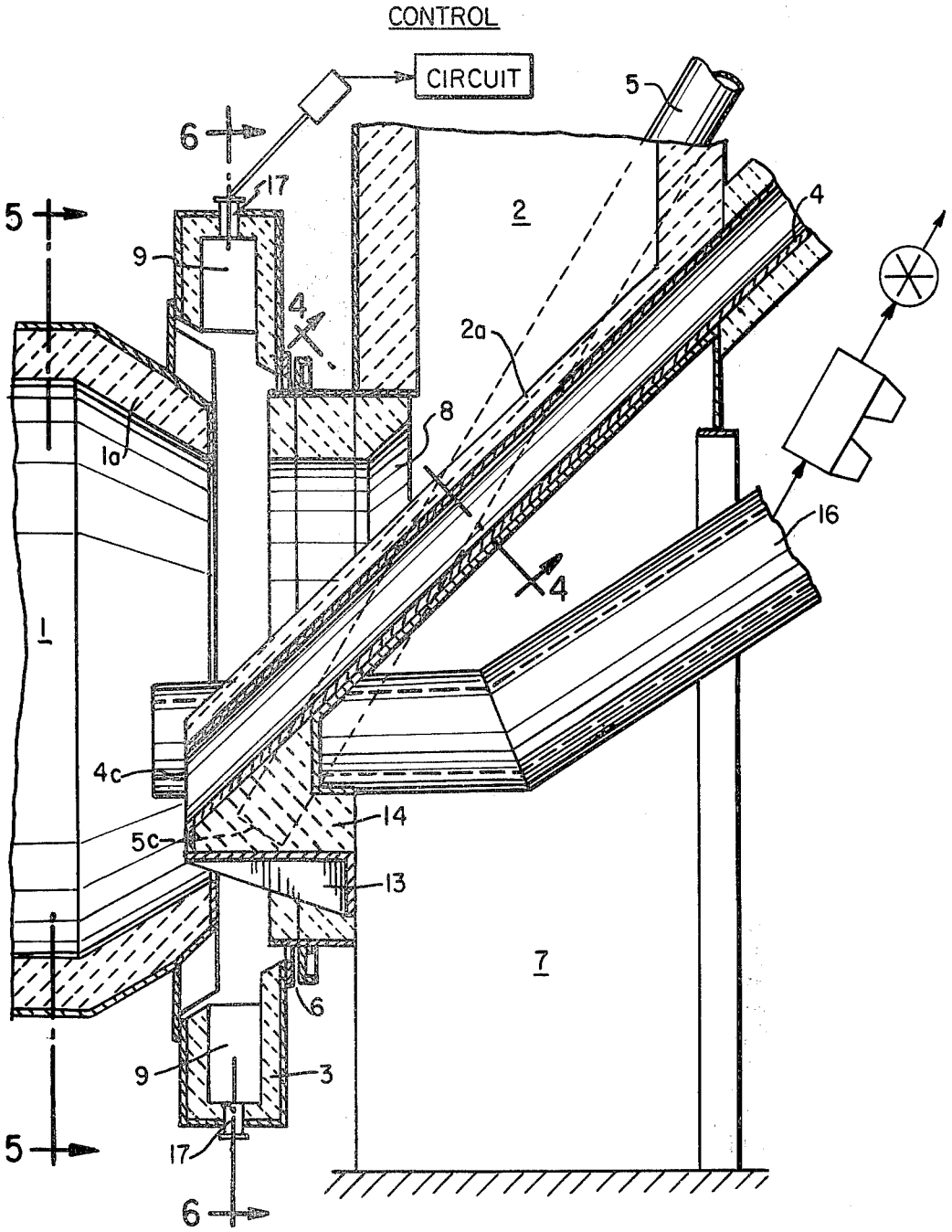
FIG. 3 is a detailed cross-sectional view of the upper end portion of the rotary kiln of FIG. 1.
Figure 5:
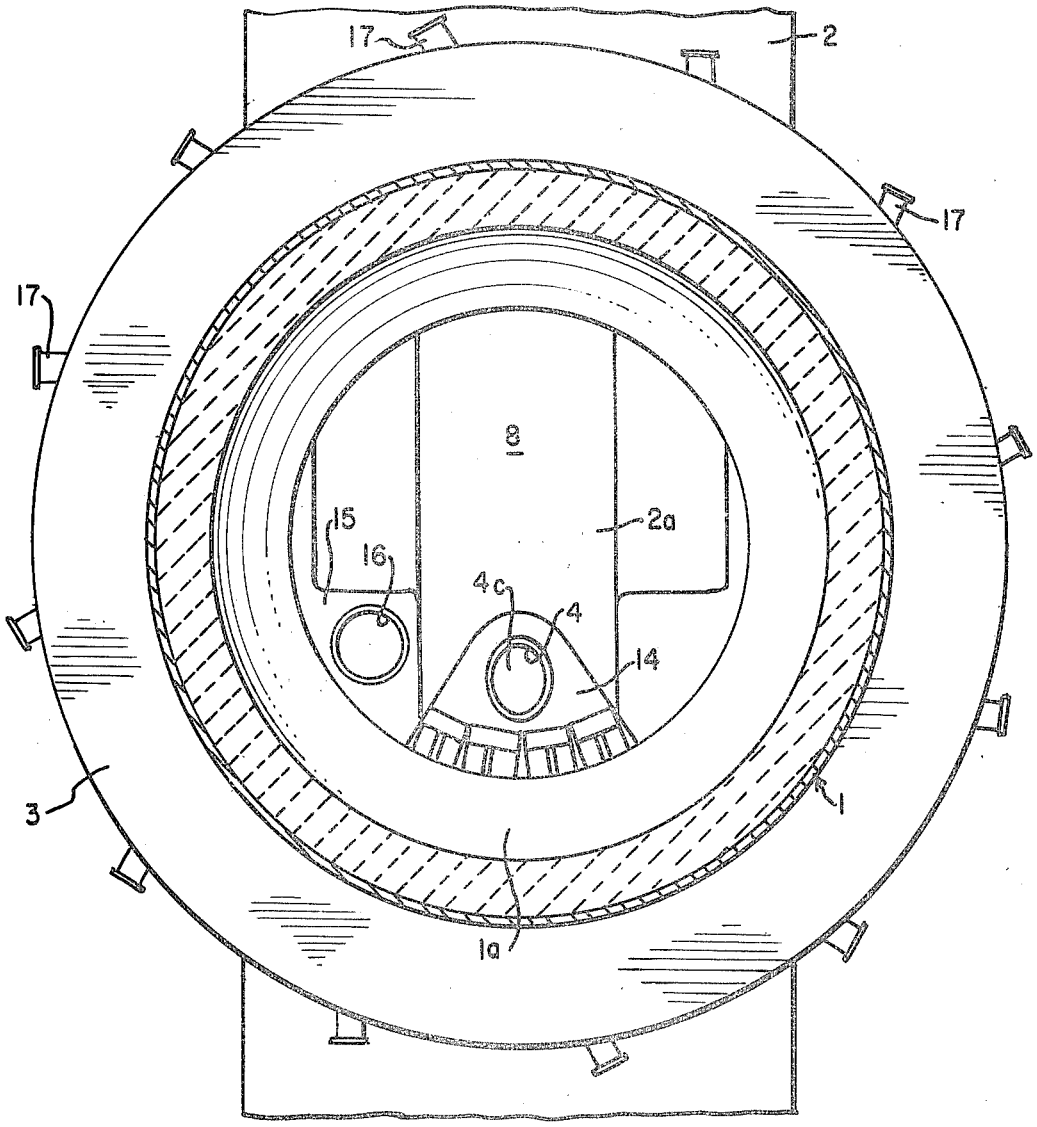
FIG. 5 is a cross-sectional view taken along lines 5—5 of FIG. 3.
Figure 6:
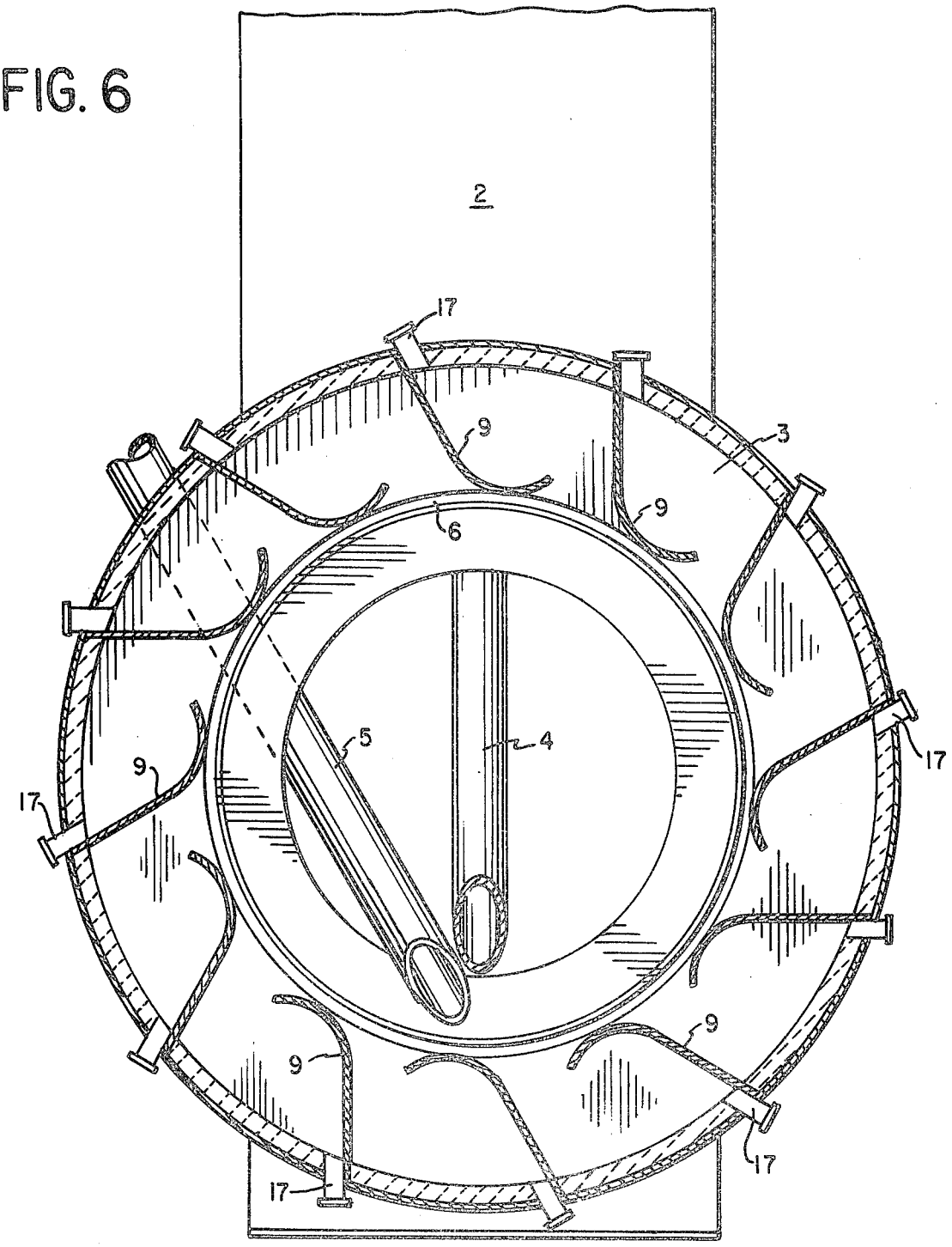
FIG. 6 is a view taken along lines 6—6 of FIG. 3 and with scoop blades of a different configuration.
Figure 7:
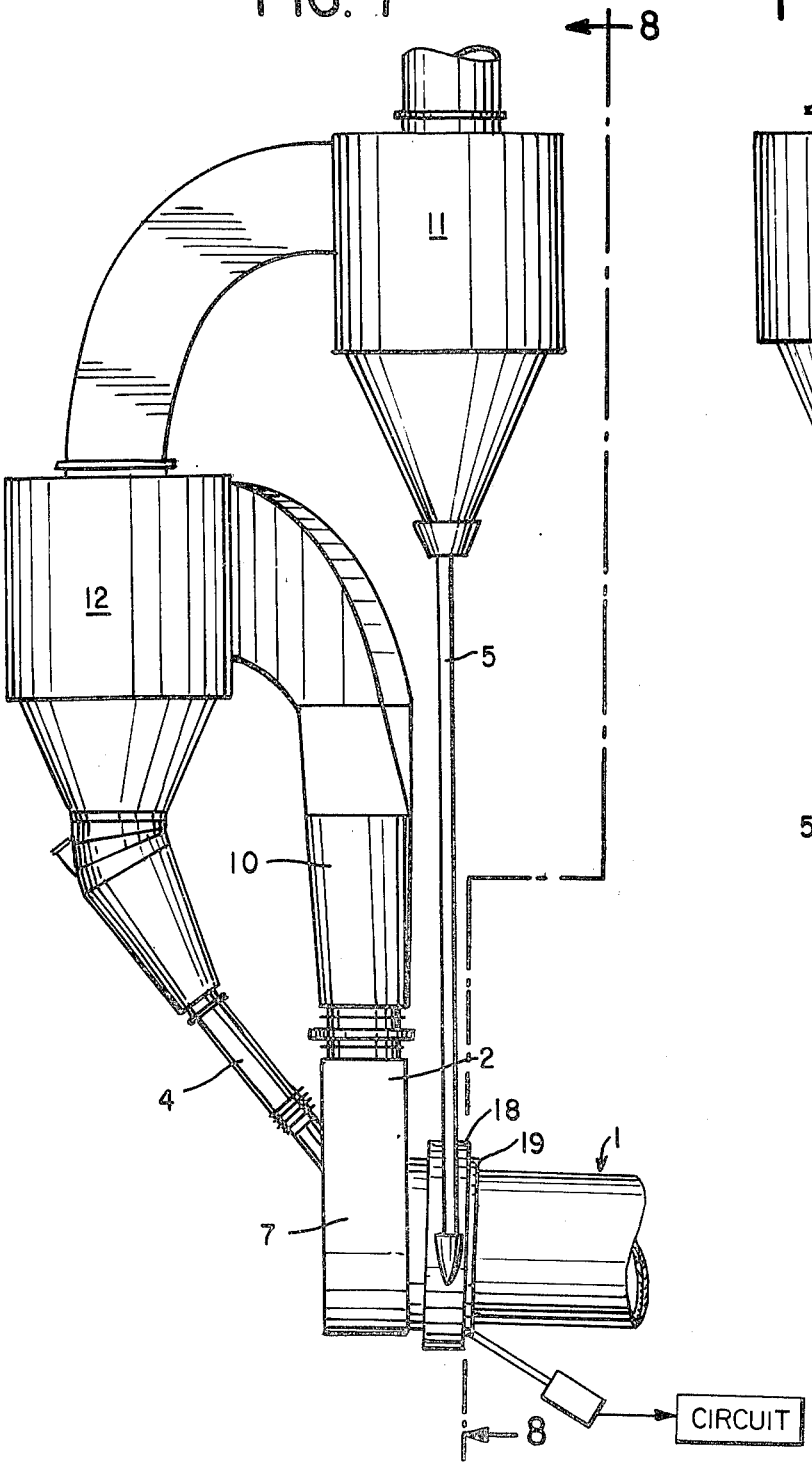
FIG. 7 is a view similar to FIG. 1, but of a second embodiment of the invention.

FIGS. 3 and 5 show the possible mounting of a bypass pipe 16 for the reception and passage of exit gases from the interior of the kiln to a precipitator shown schematically in FIG. 7.

Figure 8:
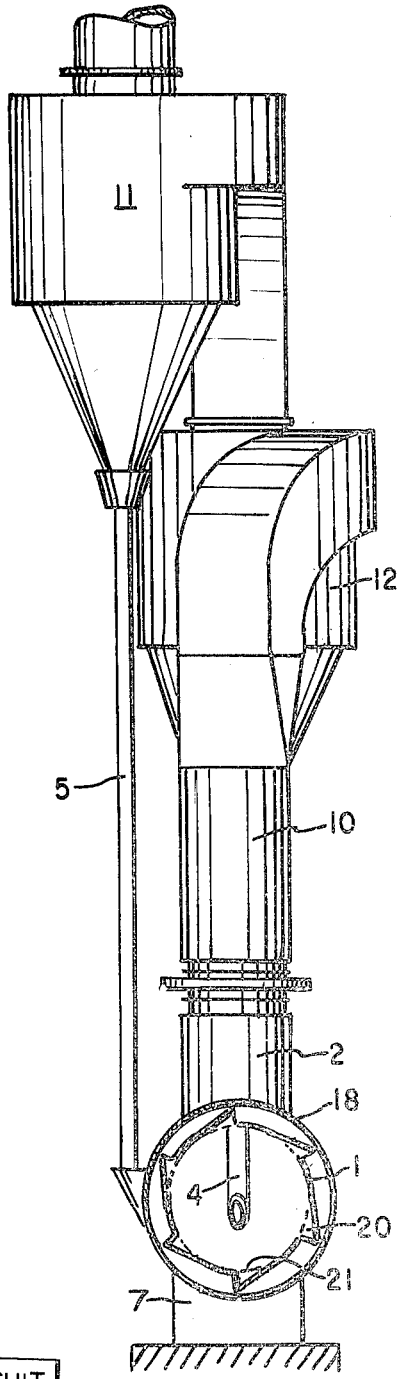
FIG. 8 is a view taken along lines 8—8 of FIG. 7.

In the embodiment of the invention shown in FIGS. 7 and 8, a stationary casing 18 communicates with the smoke chamber 2 and encircles the upper material inlet end of the rotary kiln 1. The casing 18 has a seal 19, which seals the opening through which the rotary kiln extends into the interior of the casing 18. Seal 19 may be automatically or manually controlled as illustrated schematically in FIG. 7. This portion of the rotary kiln is provided with scoops 20, communicating with the interior of the kiln through openings 21 in the kiln shell. The supply pipe 5 leads into the casing 18 and discharges the raw material which is then lifted by the scoops 20 and dispersed into the gases exiting from the kiln.

Figure 9:
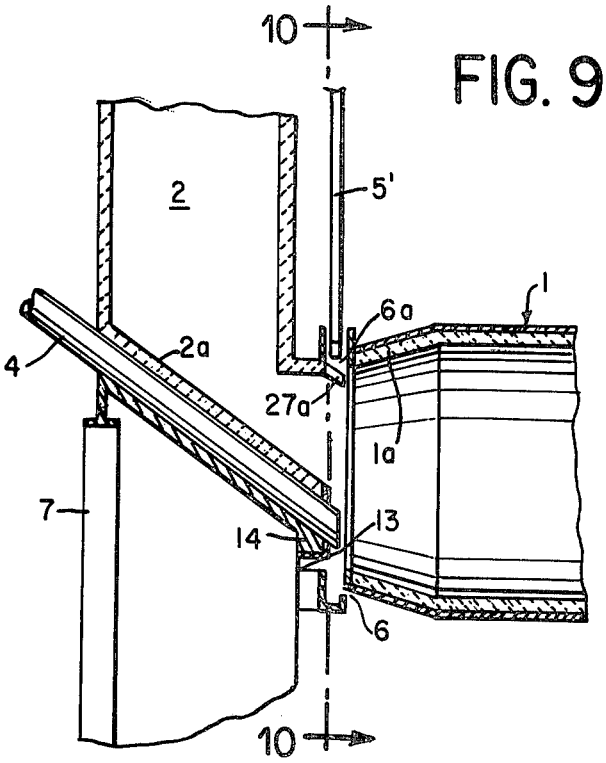
FIG. 9 is a side view, partially in cross-section, illustrating the upper kiln end of a third embodiment of the invention.
Figure 10:
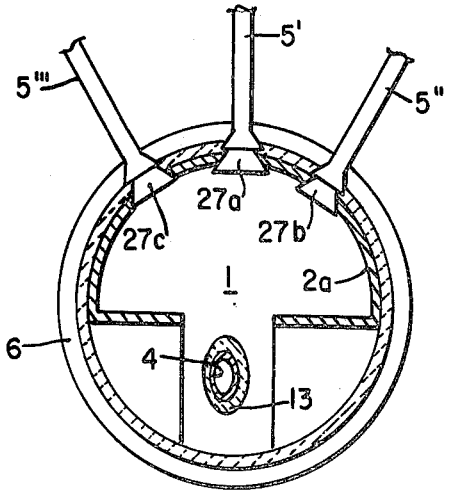
FIG. 10 is a view, partially in cross-section, taken along lines 10—10 of FIG. 9.

A third embodiment of the inventive plant is shown in FIGS. 9 and 10. Referring to those Figs., there is illustrated a rotary kiln 1, a smoke chamber 2, a pipe 4 for supplying raw material from the lowermost preheater stage to the kiln 1, pipes 5', 5'' and 5''' for passing raw material from the penultimate or preceding preheater stages of a preheater string directly into a slot 6a between the kiln 1 and the smoke chamber 2. A sealing device 6 is positioned between the kiln 1 and the smoke chamber 2. FIGS. 9 and 10 also show a support 7 for supporting the smoke chamber 2 and a support 13 for supporting the end of the pipe 4. Dispersion plates 27a, b, and c are mounted at the inner circumference of the slot 6a on the portion of the wall of the smoke chamber which faces the upper portion of the rotary kiln shell, beneath each of the pipes 5', 5'' and 5'''. The dispersion plates 27a, b, and c have downwardly inclined surfaces to facilitate the desired dispersion of raw material from pipes 5' through 5''' into the gases passing out of the kiln 1. The number of pipes coming from the penultimate or preceding preheater stages are not limited to those shown in the Figs., but may vary according to preferred constructions. If desired, one or more of the pipes may be equipped with pumping devices for feeding the raw material to the slot 6a. In other respects, the illustrated plant operates analogously to the preceding plants.

Figure 11:
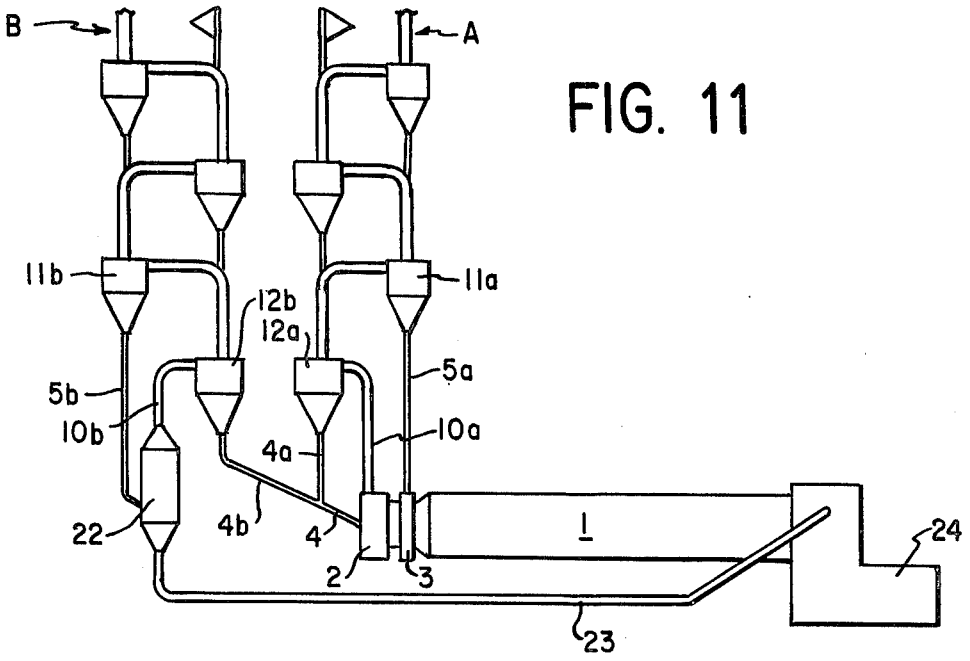
FIGS. 11, 12 and 13 are diagrammatic side elevational views of alternate embodiments of the rotary kiln plant according to the invention having multi-string preheaters.

According to the alternate embodiment of FIG. 11, the material is preheated in two parallel multi-stage cyclone preheater strings "A" and "B" before passing through a kiln 1 and into a cooler 24. Hot kiln exit gases pass from the kiln, past the dispersing device, through smoke chamber 2 and riser pipe 10a and into the last cyclone preheater stage 12a of kiln string "A". Material from the penultimate cyclone stage 11a of the kiln string "A" passes down through a pipe 5a into a dispersing device 3 before being carried out through the smoke chamber 2 suspended in the kiln exit gases.

Hot spent cooling air is fed from the cooler 24 through a pipe 23 and a calciner 22 to the cooling air string "B". In calciner 22 fuel is burnt which is nourished by a portion of the spent cooling air. The calciner 22 is connected to a riser pipe 10b which is in turn connected to the lowermost cyclone stage 12b of the cooling air string "B". Material from the penultimate cyclone stage 11b of string "B" is fed via pipe 5b into the calciner 22. The preheated material of the last cyclone stage 12a of string "A" which has been at least partly calcined by the heat from kiln exit gases and the at least partly calcined material of the last cyclone stage 12b of string "B" are fed through pipes 4a and 4b respectively, through a common pipe 4 and into the kiln 1 upstream with respect to the flow of kiln exit gases, the dispersing device 3. The pipe 4a may also incorporate a calciner in accordance with commonly assigned U.S. Patent Application No. 626,478, filed Oct. 28, 1975, now U.S. Pat. No. 4,045,162. This incorporation would allow the two strings "A" and "B" to be of equal dimensions.

Figure 12:
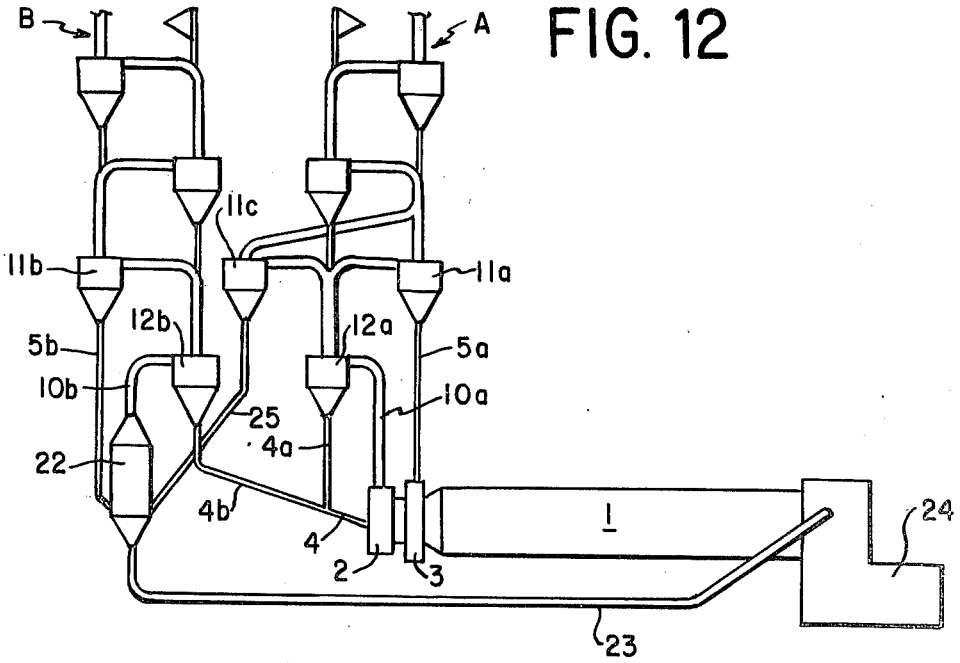

The embodiment of the invention shown in FIG. 12 differs from the embodiment of FIG. 11 in that the material passing into the cyclone stage 12a of the preheater string "A" is divided into two flows. The first flow passes to the penultimate cyclone stage 11a and the other flow passes to a parallel cyclone stage 11c. The material from the cyclone stage 11a is introduced via pipe 5a into the dispersing device 3 and suspended in the kiln exit gases for substantially complete calcination in the riser pipe 10a. The material passing to the cyclone stage 11c passes from the kiln string "A" through a pipe 25 into the calciner 22 of kiln string "B" where it is combined with the material from the cyclone stage 11b, calcined and subsequently passes through pipe 10b, the cyclone stage 12b, the pipes 4b and 4, and the kiln 1. With this construction, it is possible to obtain a lowered temperature of the kiln exit gases and an improved total precalcining of the plant.

Figure 13:
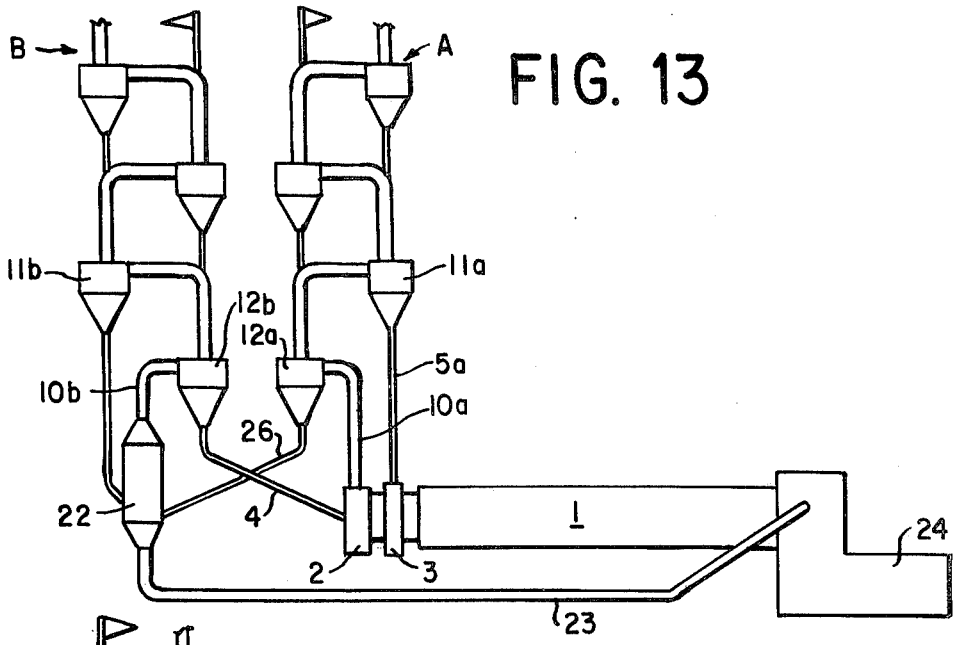

According to the alternate embodiment of FIG. 13, all the material in the kiln string "A" is fed into the dispersing device 3, and carried through the riser pipe 10*a* to the last cyclone stage 12*a* of string "A". All the material is then directed through pipe 26 into the calciner 22 of kiln string "B" for calcining. The material from the cooling air string "B" is combined in the calciner 22 with the material from kiln string "A", and the combined material passes via riser pipe 10*b* to the last preheater stage 12*b* and via pipe 4 into the kiln. This construction permits a variation from 0% to 100% of the calcining in the kiln string without affecting the total extent of the calcining taking place before the final calcining in the kiln proper.

Figure 14:
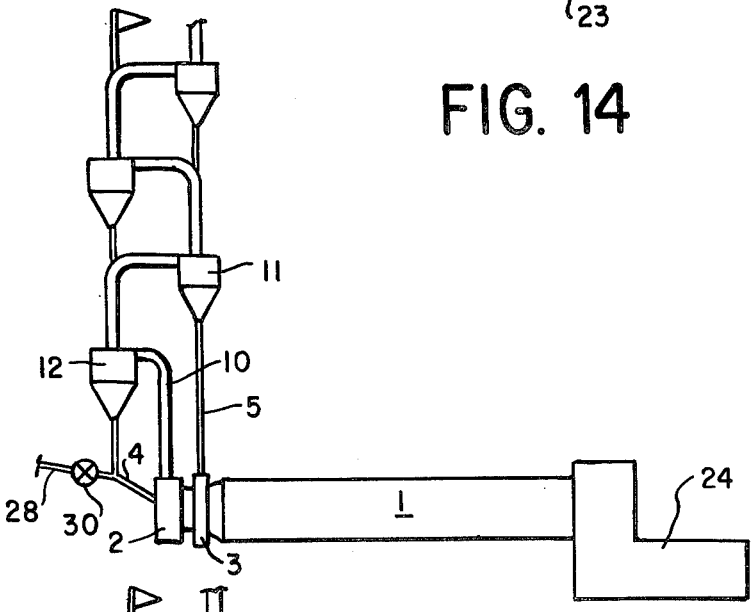
FIGS. 14 and 15 are diagrammatic side elevational views of alternate embodiments of the rotary kiln plant according to the invention having single string preheaters.

The embodiment shown in FIG. 14 generally corresponds to that of FIG. 11, except that only one preheater string is shown, and corresponding reference numerals omit the suffix letter where appropriate. Further, a pipe 28 for introducing atmospheric air is shown leading through a valve 30 into the pipe 4 which provides the second duct.

Figure 15:
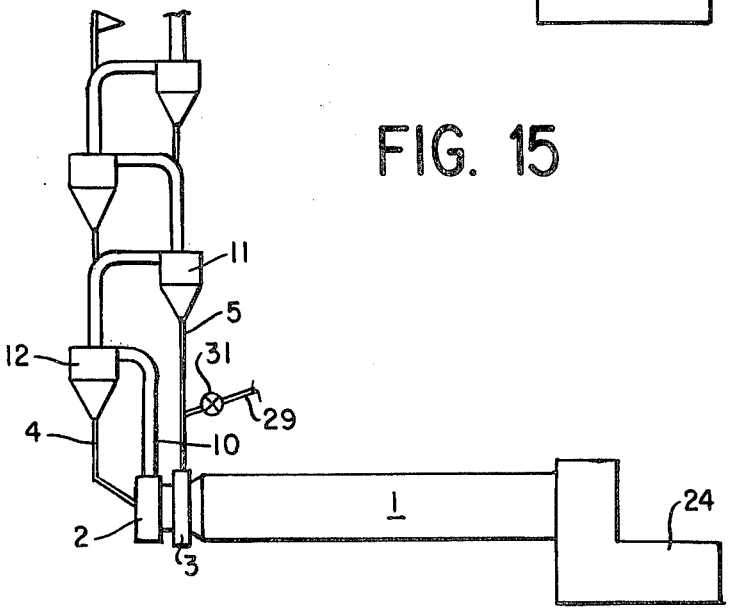

In FIG. 15, the pipe 28 is replaced by a pipe 29 which passes raw material through a valve 31 into the pipe 5 which provides the first duct.

I claim:

1. A plant for heat treating pulverous raw material which comprises:

(a) a kiln having an upper material inlet end portion and a lower material outlet end portion;

(b) at least one multi-stage raw material string preheater having at least a first stage for receiving raw material to be preheated and a last stage communicating with the upper material inlet end portion of the kiln;

(c) a smoke conduit communicating the upper material inlet end portion of the kiln with the preheater;

(d) a chamber communicating the upper material inlet end portion of the kiln with the smoke conduit and adapted to receive preheated material from at least one preheater stage;

(e) means for feeding to said chamber, preheated material from at least one preheater stage preceding the last stage of the asssociated preheater string;

(f) means positioned at least partially within said chamber for dispersing the material received therein into the hot gases exiting the material inlet end portion of the kiln so as to be suspended by said gases passing therethrough and at least partially calcined while being directed through said smoke conduit to the last stage of said preheater string; and (g) means for feeding said preheated, at least partially calcined material from the last stage of each preheater string to the upper material inlet end portion of the kiln at a location upstream with respect to the kiln exit gases, of the location of said chamber so as to pass down through the kiln for further heat treatment.

2. The kiln plant according to claim 1 wherein said chamber communicating the upper material inlet end portion of the kiln with said smoke conduit is stationary.

3. The rotary kiln plant according to claim 2 wherein said means for dispersing material comprises at least one material sprinkling plate positioned within said chamber at a location which facilitates sprinkling of the preheated, at least partially calcined material into the hot kiln exit gases.

4. A rotary kiln plant for heat treating pulverous cement raw material which comprises:

(a) an inclined rotary kiln having an upper material inlet end portion for reception of preheated, at least partially calcined cement material and a lower material outlet end portion for exiting cement clinker;

(b) a multi-stage raw material cyclone string preheater having at least a first cyclone stage for reception of cement raw material to be preheated and a last cyclone stage communicating with the upper material inlet end portion of the cyclone;

(c) a smoke chamber having a gas inlet facing the upper material inlet end portion of the kiln and a gas outlet connected to the cyclone string preheater and communicating the upper material inlet end portion of the kiln with the preheater, said smoke chamber having a gas inlet opening having a cross-sectional area less than the cross-sectional area of the opening of the material inlet end of the kiln so as to provide a reduced cross sectional area which causes a substantial increase in the velocity of the gases exiting the kiln;

(d) a scoop chamber connected to the upper material inlet end portion of the kiln for rotation therewith and communicating the kiln with the smoke chamber for receiving preheated cement material from a preheater cyclone stage preceding the last cyclone stage of said string preheater, said scoop chamber having a plurality of scoop members positioned therein for receiving and dispersing the raw material fed therein into the hot gases exiting from the material inlet end portion of the kiln;

(e) a first pipe for feeding said preheated cement material from said cyclone stage of said preheater preceding said last cyclone stage to said scoop chamber so as to facilitate dispersion of said material by said scoop members into the gases exiting the upper material inlet end portion of the kiln so as to be suspended in said gases passing through said chamber and at least partially calcined while being directed from said scoop chamber and through said smoke chamber with said gases to the last cyclone stage of the preheater; and (f) a second pipe for feeding said preheated, at least partially calcined cement material from the last stage of the preheater into the rotary kiln proper at a location upstream with respect to the flow of kiln exit gases of the location of said scoop chamber such that said preheated, at least partially calcined material passes down through the rotary kiln for further heat treatment.

5. A kiln plant for heat treating pulverous raw material which comprises:

(a) an inclined rotary kiln having an upper material inlet end portion and a lower material outlet end portion;

(b) at least one multi-stage raw material cyclone preheater string having at least a first cyclone stage for receiving raw material to be preheated and a last cyclone stage communicating with the upper material inlet end of the kiln;

(c) a smoke conduit having a gas inlet facing the material inlet end of the kiln and a gas outlet connected to the last preheater stage and communicating the upper material inlet end portion of the kiln with the preheater;

(d) a chamber positioned between the upper material inlet end portion of the kiln and the smoke conduit communicating said kiln and said smoke conduit and for receiving preheated raw material from at least one preheater cyclone stage preceding the last cyclone stage of the preheater;

(e) means for feeding to said chamber, preheated raw material from said at least one preheater cyclone stage preceding the last stage of the associated preheater string;

(f) means positioned within said chamber for dispersing raw material received therein into the hot gases exiting the upper material inlet end portion of the kiln so as to be suspended by said gases passing therethrough while providing cooling for the gases exiting the kiln, said material being at least partially calcined while being directed from said chamber through said smoke conduit with said gases to the last stage of said preheater string; and (g) means for feeding said preheated, at least partially calcined raw material from the last stage of the preheater to the upper material inlet end portion of the rotary kiln at a location upstream with respect to the flow of kiln exit gases, of the location of said chamber so as to pass down through the kiln for further heat treatment.

6. The rotary kiln plant according to claim 5 wherein said chamber has a generally annular configuration.

7. The rotary kiln plant according to claim 6 further comprising an automatically or manually selectively operated variable air sealing device positioned between the chamber and the smoke conduit and adapted to permit air to be selectively drawn into said rotary chamber.

8. The rotary kiln plant according to claim 6 wherein said dispersing means comprises a plurality of blades connected to the inner circumferential portions of the rotary chamber at a generally acute angle relative thereto.

9. The rotary kiln plant according to claim 6 which further comprises at least one by-pass pipe having one end communicating with the lowermost portion of the upper material inlet end portion of the kiln and the other end communicating with dust precipitation means such that hot kiln gases may pass through said by-pass pipe and into said precipitator.

10. The kiln plant according to claim 6 wherein the means for feeding said preheated, at least partially calcined raw material from the last stage of the preheater string comprises a pipe having one end connected to the last stage of the preheater string and its other end communicating with and projecting into the material inlet end portion of the kiln proper at a position upstream with respect to the kiln exit gases, off the location of the dispersing means.

11. The kiln plant according to claim 6 which further comprises means for selectively supplying supplementary air to a kiln inlet end portion via the first material feeding means from said preheater stage preceding said last stage of said associated preheater string.

12. The rotary kiln plant according to claim 6 which further comprises means for selectively supplying supplementary air to the kiln inlet end portion via said first material feeding means from said cyclone preheater stage preceding the last stage of said preheater string.

13. The rotary kiln plant according to claim 6 wherein the inlet opening of said smoke chamber is dimensioned less than the kiln opening so as to cause a substantial flow restriction so as to thereby increase the velocity of the kiln exit gases passing therethrough.

14. The rotary kiln plant according to claim 6 wherein said annular chamber has a generally circular cross-sectional configuration and is connected to the upper material inlet end portion of the kiln to rotate therewith so as to form a rotary chamber.

15. The rotary kiln plant according to claim 14 wherein said means for dispersing material within said chamber comprises at least one material dispersing plate positioned at the material dispensing end of a material dispensing pipe and having a surface inclined generally downwardly relative to the rotational axis of said chamber to disperse raw material from said material dispensing pipe.

16. The rotary kiln plant according to claim 14 wherein said dispersing means comprises a plurality of scoop members positioned about inner peripheral portions of said rotary chamber and extending generally inwardly of said chamber.

17. The rotary kiln plant according to claim 16 wherein the inner circumferential portion of the kiln is configured so so to diverge from the upper material inlet end portion of the kiln in a direction toward the kiln proper, and the diameter of the inner circumferential portion of the rotary chamber is greater than the inner circumference of the upper material inlet end portion of the kiln, but less than the diameter of the kiln proper.

18. The rotary kiln plant according to claim 17 wherein the means for feeding preheated, at least partially calcined raw material from the penultimate stage of the preheater comprises a pipe having one end connected to the penultimate stage of the preheater string and the other end communicating with the rotary chamber such that a raw material passes from the penultimate stage of the preheater through the pipe and discharges into the lowermost portion of the rotary chamber.

19. The rotary kiln plant according to claim 18 wherein said members connected to the inner peripheral portions of the rotary chamber are located and configured so as to be recessed in relation to inner circumferential portions of the upper material inlet end portion of the kiln and thereby are positioned away from direct contact with the flow of hot kiln exit gases.

20. The rotary kiln plant according to claim 16 wherein the inlet opening of said smoke chamber is dimensioned less than the kiln opening so as to cause a substantial flow restriction so as to thereby increase the velocity of the kiln exit gases passing therethrough.

21. The rotary kiln plant according to claim 14 wherein said dispersing means comprises a plurality of compartments formed within the inner periphery of the rotary chamber, said compartments having at least one of a pocket-like and box-like configuration.

22. The rotary kiln plant according to claim 5 wherein said means for dispersing material within said chamber comprises at least one material dispersing plate positioned at the material dispensing end of a material dispensing pipe and having a surface inclined generally downwardly relative to the rotational axis of said chamber to disperse raw material from said material dispensing pipe.

23. The rotary kiln plant according to claim 22 wherein said chamber further comprises at least one Best Available Copy opening communicating the interior of said chamber with the outside atmosphere and having manually or automatically operated control means positioned thereon such that air may be selectively drawn through said at least one opening into said chamber and into said smoke conduit.

24. The rotary kiln plant according to claim 22 which further comprises at least one opening having automatically or manually selectively operated control means positioned about the communicating portions of said chamber and the smoke conduit such that air may be selectively drawn through said at least one opening into said chamber.

25. The rotary kiln plant according to claim 22 wherein the inlet opening of said smoke chamber is dimensioned less than the kiln opening so as to cause a substantial flow restriction so as to thereby increase the velocity of the kiln exit gases passing therethrough from said kiln.

26. The rotary kiln plant according to claim 22 which further comprises at least one by-pass pipe having one end communicating with the lowermost portion of the upper material inlet end portion of the kiln and the other end communicating with dust precipitation means such that hot kiln gases may pass through said by-pass pipe and into said precipitator.

27. The rotary kiln plant according to claim 5 wherein said chamber further comprises at least one opening communicating the interior of said chamber with the outside atmosphere and having manually or automatically operated control means positioned thereon such that air may be selectively drawn through said at least one opening into said chamber and into said smoke conduit.

28. The rotary kiln plant according to claim 5 which further comprises at least one opening having automatically or manually selectively operated control means positioned about the communicating portions of said chamber and the smoke conduit such that air may be selectively drawn through said at least one opening into said chamber.

29. The rotary kiln plant according to claim 5 wherein the inlet opening of said smoke chamber is dimensioned less than the kiln opening so as to cause a substantial flow restriction so as to thereby increase the velocity of the kiln exit gases passing therethrough from said kiln.

30. The rotary kiln plant according to claim 14 further comprising an automatically or manually selectively operated variable air sealing device positioned between said rotary chamber and the smoke conduit and adapted to permit air to be selectively drawn into said rotary chamber.

31. The rotary kiln plant according to claim 5 which further comprises at least one by-pass pipe having one end communicating with the lowermost portion of the upper material inlet end portion of the kiln and the other end communicating with dust precipitation means such that hot kiln gases may pass through said by-pass pipe and into said precipitator.

32. The kiln plant according to claim 5 wherein the means for feeding said preheated, at least partially calcined raw material from the last stage of the preheater string comprises a pipe having one end connected to the last stage of the preheater string and its other end communicating with and projecting into the material inlet end portion of the kiln proper at a position upstream with respect to the kiln exit gases, off the location of the dispersing means.

33. The kiln plant according to claim 5 which further comprises means for selectively supplying supplementary air to the kiln inlet end portion via a first material feeding means from said preheater stage preceding said last stage of said associated preheater string.

34. The rotary kiln plant according to claim 5 which further comprises means for selectively supplying supplementary air to the kiln inlet end portion via a first material feeding means from said cyclone preheater stage preceding the last stage of said preheater string.

35. The rotary kiln plant according to claim 5 which further comprises a multi-string preheater and a clinker cooling means for cooling the kiln product, at least one string being fed with hot kiln exit gases and at least another string being fed with hot spent cooling air from said clinker cooling means.

36. The rotary kiln plant according to claim 35 which further comprises a preheater having at least two substantially equal strings.

37. The rotary kiln plant according to claim 36 which further comprises a preheater having at least two strings, a first string connected to the kiln outlet end portion and a second string connected to said clinker cooling means, means for varying the calcination of material in said kiln gas string, means associated with said second string for calcining preheated material, means for transferring a divisional flow of preheated, at least partially calcined material from said kiln gas string to said calcining means for further calcination.

38. The rotary kiln plant according to claim 35 which further comprises a preheater having at least two strings, a first string connected to the kiln outlet end portion and a second string connected to said clinker cooling means, means for varying the calcination of material in said kiln gas string, means associated with said second string for calcining preheated material, means for transferring a divisional flow of preheated, at least partially calcined material from said kiln gas string to said calcining means for further calcination.

39. The rotary kiln plant according to claim 35 which further comprises a preheater having at least two multi-stage cyclone preheater strings, a first string connected to the kiln gas outlet end portion and a second string connected to said clinker cooling means, a calcining chamber connected to said second string preheater, means for transferring a divisional flow of preheated material from said first string to said calcining chamber, for further calcination therein, means for selectively introducing supplementary air into the kiln gas preheater string positioned medially between the kiln outlet end portion and the penultimate cyclone stage of said preheater string.

* * * * *

UNITED STATES PATENT AND TRADEMARK OFFICE

CERTIFICATE OF CORRECTION

PATENT NO. : 4,125,363

DATED : November 14, 1978

INVENTOR(S) : Dan S. Hansen

It is certified that error appears in the above-identified patent and that said Letters Patent are hereby corrected as shown below:

Column 3, lines 50-51, "accomodate" should read -- accommodate --

Column 5, line 28, "form" should read -- from --

Column 6, line 47, after "gases," and before "the" insert -- of --

Column 6, line 67, after "and" and before "the" insert -- into --

Column 10, line 26 (Claim 17, line 3) "so" second occurrence should read -- as --

Signed and Sealed this

Tenth Day of April 1979

[SEAL]

*Attest:*

RUTH C. MASON
*Attesting Officer*

DONALD W. BANNER
*Commissioner of Patents and Trademarks*